US006584960B2

(12) United States Patent
Kishibata et al.

(10) Patent No.: US 6,584,960 B2
(45) Date of Patent: Jul. 1, 2003

(54) ATMOSPHERIC PRESSURE DETECTING METHOD FOR CONTROLLING INTERNAL COMBUSTION ENGINE AND APPARATUS THEREFOR

(75) Inventors: Kazuyoshi Kishibata, Numazu (JP); Yuichi Kitagawa, Numazu (JP); Hiroyasu Sato, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/213,325

(22) Filed: Aug. 5, 2002

(65) Prior Publication Data

US 2003/0037770 A1 Feb. 27, 2003

(30) Foreign Application Priority Data

Aug. 22, 2001 (JP) ..... 2001-251948

(51) Int. Cl.[7] ..... F02M 51/00

(52) U.S. Cl. ..... 123/478; 123/494

(58) Field of Search ..... 123/478, 434, 123/480, 494, 435

(56) References Cited

U.S. PATENT DOCUMENTS 4,495,921 A * 1/1985 Sawamoto ..... 123/438
4,951,647 A 8/1990 Ezumi et al.

FOREIGN PATENT DOCUMENTS

| | | |
|---|---|---|
| JP | 59-188530 | 10/1984 |
| JP | 2505529 | 8/1996 |
| JP | 2505530 | 8/1996 |

* cited by examiner

*Primary Examiner*—Bibhu Mohanty
(74) *Attorney, Agent, or Firm*—Pearne & Gordon LLP

(57) ABSTRACT

An atmospheric pressure detecting method for controlling an internal combustion engine, which can detect atmospheric pressure and takes the atmospheric pressure as one of control conditions of the internal combustion engine without using a throttle sensor and an atmospheric pressure sensor, is provided; wherein a maximum value and a minimum value of intake pipe pressure generating while the internal combustion engine performs one combustion cycle are detected; wherein an absolute value of a difference between the maximum value and the minimum value of the intake pipe pressure is detected as an intake pipe pressure change quantity; and wherein the maximum value of the intake pipe pressure is taken as a detection value of atmospheric pressure when the intake pipe pressure change quantity is equal to or less than a set value.

12 Claims, 7 Drawing Sheets

PbAD: NEWLY DETECTED INTAKE PIPE PRESSURE
PbmaxS: MAXIMUM VALUE OF INTAKE PIPE PRESSURE DETECTED BEFORE
PbminS: MINIMUM VALUE OF INTAKE PIPE PRESSURE DETECTED BEFORE PbAD: NEWLY DETECTED INTAKE PIPE PRESSURE
PbmaxS: MAXIMUM VALUE OF INTAKE PIPE PRESSURE DETECTED BEFORE
PbminS: MINIMUM VALUE OF INTAKE PIPE PRESSURE DETECTED BEFORE Pmax: MAXIMUM VALUE OF INTAKE PIPE PRESSURE DURING ONE COMBUSTION CYCLE
Pmin: MINIMUM VALUE OF INTAKE PIPE PRESSURE DURING ONE COMBUSTION CYCLE
ΔPb: INTAKE PIPE PRESSURE CHANGE QUANTITY DURING ONE COMBUSTION CYCLE ΔPb2: SET VALUE OF INTAKE PIPE PRESSURE CHANGE QUANTITY
n: SET VALUE OF NUMBER OF COMBUSTION CYCLES
Pa: ATMOSPHERIC PRESSURE DETECTION VALUE

ATMOSPHERIC PRESSURE DETECTING METHOD FOR CONTROLLING INTERNAL COMBUSTION ENGINE AND APPARATUS THEREFOR

TECHNICAL FIELD OF THE INVENTION

The present invention relates to an atmospheric pressure detecting method which detects atmospheric pressure as one of control conditions which is used when controlling an internal combustion engine, and an atmospheric pressure detecting apparatus used for carrying out the method.

BACKGROUND OF THE INVENTION

It is sometimes necessary to use atmospheric pressure as a control condition when controlling an internal combustion engine. For example, when controlling a fuel injection quantity from an injector for supplying fuel to an engine, atmospheric pressure, intake air temperature, temperature of cooling water of the engine (temperature of the engine) and the like, other than an intake air quantity that is taken into a cylinder through an intake pipe, are detected as control conditions, and the fuel injection quantity necessary to keep an air-fuel ratio within a proper range with respect to these control conditions is determined. Therefore, in the internal combustion engine supplied with fuel from the injector, a throttle sensor for detecting an opening degree of a throttle, an intake pressure sensor for detecting intake pipe pressure at a downstream side from a throttle valve, an intake air temperature sensor, a cooling water temperature sensor and the like, as well as an atmospheric pressure sensor, are provided, so that the fuel injection quantity is arithmetically operated from output of these sensors.

As described above, it becomes necessary to mount various kinds of sensors on the engine when the fuel injection quantity from the injector is controlled. Of all these sensors, the atmospheric pressure sensor and the throttle sensor are especially expensive, and therefore it is desirable not to use these sensors in view of reducing the cost.

Thus, a speed density method is widely used as a method for controlling the fuel injection quantity from the injector. In this method, without detecting an opening degree of a throttle valve, an intake air quantity of an engine is estimated from intake pipe pressure detected at a downstream side from a throttle valve of the internal combustion engine and an engine rotational speed, and a fuel injection quantity necessary to obtain a predetermined air-fuel ratio is determined from the intake air quantity and the other control conditions. According to this method, an expensive throttle-opening sensor can be omitted, and therefore the cost can be reduced.

Meanwhile, as a method of detecting atmospheric pressure without using an atmospheric pressure sensor, the methods as disclosed in Japanese Patent Application Laid-Open Publication No. 59-188530, Japanese Patent No. 2505529, or Japanese Patent No. 2505530 are proposed.

In the method disclosed in Japanese Patent Application Laid-open Publication No. 59-188530, the intake pipe pressure at a downstream side from a throttle valve is detected as absolute pressure, and when an opening degree of the throttle valve is a predetermined value or more, and also when a rotational speed of the engine is a predetermined value or less, a correction value determined according to the throttle valve opening degree and the rotational speed of the engine is added to the intake pipe pressure, whereby an atmospheric pressure is obtained.

In the methods disclosed in Japanese Patent No. 2505529 and Japanese Patent No. 2505530, when an opening degree of a throttle valve is larger than a throttle-opening degree value previously set in accordance with a rotational speed of the engine, an atmospheric pressure is obtained by adding a correction value to the output of an intake pressure sensor which detects the intake pipe pressure.

According to the above-described conventional atmospheric pressure detecting method, the expensive atmospheric sensor can be omitted, but in the conventional atmospheric detecting method, it is essential to detect the opening degree of the throttle valve, and thus it is necessary to provide a throttle sensor in the engine. Consequently, the conventional atmospheric pressure detecting method has a disadvantage that it cannot be applied to an internal combustion engine for controlling fuel injection by the speed density method which determines the fuel injection quantity by estimating the intake air quantity from the rotational speed of the engine and the intake pipe pressure without using a throttle sensor.

SUMMARY OF THE INVENTION

Consequently, an object of the present invention is to provide an atmospheric pressure detecting method for controlling an internal combustion engine, which detects atmospheric pressure without using an atmospheric sensor and a throttle sensor, and an atmospheric pressure detecting apparatus for carrying out the method.

The present invention is applied to a method for detecting atmospheric pressure which is used as a control condition when controlling a fuel injection quantity from an injector for supplying fuel to a single cylinder internal combustion engine or a multi-cylinder internal combustion engine having an intake pipe and a throttle valve for each cylinder. In the present invention, intake pipe pressure detection means for sampling the intake pipe pressure at a downstream side from the throttle valve of the internal combustion engine at predetermined sampling intervals and detecting the sampled pressure as absolute pressure, is provided, an absolute value of a difference between a maximum value and a minimum value of the intake pipe pressure sampled while the internal combustion engine performs one combustion cycle is obtained as an intake pipe pressure change quantity, and the maximum value of the intake pipe pressure is taken as a detection value of atmospheric pressure when the intake pipe pressure change quantity is equal to or less than the set value.

In a single cylinder internal combustion engine and a multi-cylinder internal combustion engine provided with an intake pipe and a throttle valve for each cylinder, the intake pipe pressure is varied with the change of the strokes. The intake pipe pressure of the single cylinder internal combustion engine and the multi-cylinder internal combustion engine provided with the intake pipe and the throttle valve for each cylinder is reduced when an intake stroke is started, and is kept reducing until an end of the intake stroke. When the intake stroke is finished, air flows into the intake pipe due to a pressure difference between the atmospheric pressure at an upstream side from the throttle valve and negative pressure in the intake pipe, and therefore the intake pipe pressure rises to the atmospheric pressure. Seeing a change in the intake pipe pressure while the engine performs one combustion cycle, the intake pipe pressure shows the minimum value in the vicinity of timing in which the intake stroke is finished, and shows the maximum value at suitable timing during the time until the next intake stroke is started.

In a state in which the throttle valve is hardly opened, the change amount (reduction amount) of the intake pipe pressure is large, and since the next intake stroke is started before the intake pipe pressure reaches atmospheric pressure after the intake stroke is finished, the maximum value of the intake pipe pressure shows a value lower than the atmospheric pressure. On the other hand, in a state in which the throttle valve is opened to some extent or more (in a state in which a load larger than a light load is applied to the engine), the change quantity of the intake pipe pressure becomes small, and since the intake pipe pressure reaches the atmospheric pressure by the time when the next intake stroke is started after the intake stroke is finished, the maximum value of the intake pipe pressure becomes substantially equal to the atmospheric pressure. Accordingly, the absolute value of the difference between the maximum value and the minimum value of the intake pipe pressure is obtained as the intake pipe pressure change quantity, and the maximum value of the intake pipe pressure is taken as the detection value when the intake pipe pressure change quantity is equal to or less than the set value, whereby the atmospheric pressure can be detected without using an expensive atmospheric sensor and a throttle sensor.

It is preferable that the atmospheric pressure detecting apparatus for carrying out the above-described detecting method has the construction including intake pipe pressure detection means for sampling output of an intake pressure sensor, which is provided to detect intake pipe pressure at a downstream side from the throttle valve in the intake pipe provided for one cylinder of the internal combustion engine, at predetermined sampling intervals and detecting the intake pipe pressure as absolute pressure, maximum/minimum value detection means for detecting a maximum value and a minimum value of the intake pipe pressure detected while the internal combustion engine performs one combustion cycle, intake pipe pressure change quantity detection means for obtaining an absolute value of a difference between the maximum value and the minimum value detected by the maximum/minimum value detection means as an intake pipe pressure change quantity, atmospheric pressure detection condition determining means for comparing the obtained intake pressure change quantity with a previously determined set value each time the intake pipe pressure change quantity detection means obtains the intake pipe pressure change quantity and determining that the atmospheric pressure detection condition is satisfied when the intake pipe pressure change quantity is equal to or less than the set value, and atmospheric pressure detection value determining means for determining the maximum value of the intake pipe pressure detected in the maximum/minimum value detection process as a detection value of atmospheric pressure when it is determined by the atmospheric pressure detection condition determining means that the atmospheric detection condition is satisfied in all combustion cycles while the internal combustion engine performs n cycle or n cycles of combustion (n represents an integer of 1 or more).

In a state in which the rotational speed of the engine is not so high, and the amount of air flowing through the inside of the intake pipe is not large, atmospheric pressure can be detected with substantially no error by the above-described method.

However, if the rotational speed of the engine becomes high and the amount of air flowing through the inside of the intake pipe becomes large, a pressure loss in the intake passage increases, thus causing a state in which the maximum value of the intake pipe pressure does not reach the atmospheric pressure. In such a state, if the maximum value of the intake pipe pressure is taken as the detection value of the atmospheric pressure, the detection error increases. Accordingly, when the above-described detection method is carried out, it is preferable that the atmospheric pressure is detected in an operation area in which the rotational speed of the engine is equal to or less than the set value, then the detection value is stored, and with the stored detection value of the atmospheric pressure being taken as one of the control conditions, the control of the engine (for example, the control of fuel injection quantity) from a low speed area to a high speed area is performed.

When the atmospheric pressure is always needed to be detected with high precision irrespective of the rotational speed of the internal combustion engine, it is preferable that the maximum value of the intake pipe pressure detected when the intake pipe pressure change quantity is equal to or less than the set value is taken as the basic detection value of the atmospheric pressure, and the value obtained by correcting the basic detection value by the correction amount determined according to the rotational speed is taken as the detection value of the atmospheric pressure.

In this case, the correction of the basic detection value may be made by adding the correction value determined according to the rotational speed of the engine to the basic detection value, or it may be made by multiplying a correction coefficient determined according to the rotational speed of the engine by the basic detection value.

As described above, in the case of carrying out the method for obtaining the detection value of the atmospheric pressure by correcting the basic detection value which is the maximum value of the intake pipe pressure when the intake pipe pressure change quantity is equal to or less than the set value being taken as the basic detection value of the atmospheric pressure, it is preferable that the atmospheric pressure detecting apparatus for carrying out the method has the construction including intake pipe pressure detection means for sampling output of an intake pressure sensor which is provided to detect intake pipe pressure at a downstream side from the throttle valve in the intake pipe provided for one cylinder of the internal combustion engine, at predetermined sampling intervals and detecting the intake pipe pressure as absolute pressure, maximum/minimum value detection means for detecting a maximum value and a minimum value of the intake pipe pressure detected while the internal combustion engine performs one combustion cycle, intake pipe pressure change quantity detection means for obtaining an absolute value of a difference between the maximum value and the minimum value detected by the maximum/minimum value detection means as an intake pipe pressure change quantity, the atmospheric pressure detection condition determining means for comparing an obtained intake pressure change quantity with a previously determined set value each time the intake pipe pressure change quantity detection means obtains the intake pipe pressure change quantity and determining that the atmospheric pressure detection condition is satisfied when the intake pipe pressure change quantity is equal to or less than the set value, the atmospheric pressure basic detection value determining means for determining the maximum value of the intake pipe pressure detected in the maximum/minimum value detection process as a basic detection value of the atmospheric pressure when it is determined by the atmospheric pressure detection condition determining means that the atmospheric detection condition is satisfied in all the combustion cycles while the internal combustion engine performs n cycle or n cycles of combustion (n represents an integer of 1 or more), rotational speed detection means for detecting rotational speed of the internal combustion engine, map storage means storing a rotational speed/correction value map which gives relationship between the rotational speed of the internal combustion engine and a correction value which needs to be added to the basic detection value to obtain the atmospheric pressure, correction value operation means for arithmetically operating a correction value from the rotational speed/correction value map in accordance with the rotational speed of the internal combustion engine detected by the rotational speed detection means, and atmospheric pressure detection value operation means for obtaining the detection value of the atmospheric pressure by adding the correction value to the basic detection value.

BRIEF DESCRIPTION OF THE DRAWINGS

The above and other objects and features of the invention will be apparent from the detailed description of the preferred embodiment of the invention, which is described and illustrated with reference to the accompanying drawings, in which.

DETAILED DESCRIPTION OF THE PREFERRED EMBODIMENTS

Figure 1:
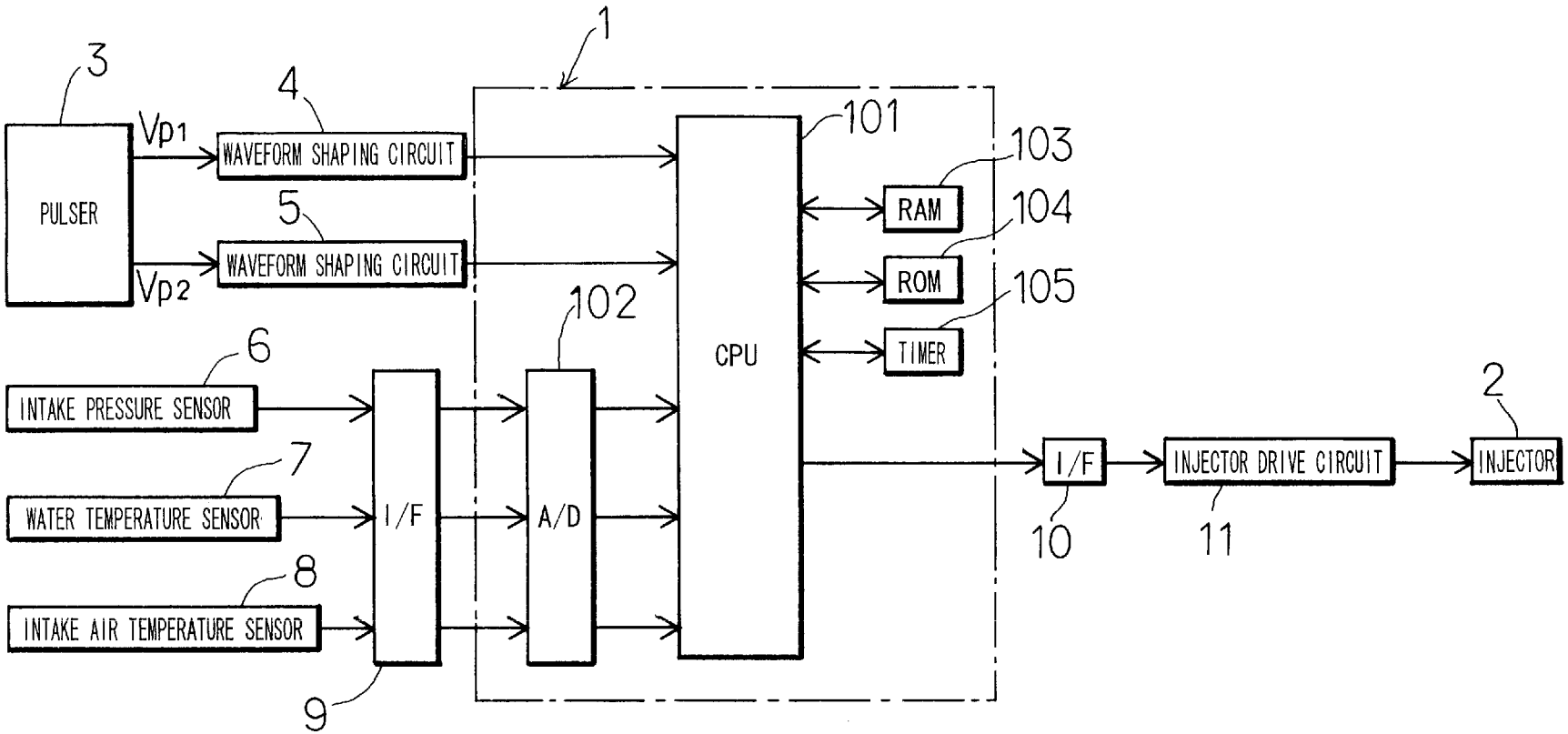
FIG. 1 is a block diagram showing an example of a construction of a hardware of an internal combustion engine control apparatus to which the present invention is applied.

An embodiment of the present invention will be explained below with reference to the accompanying drawings. FIG. 1 shows a construction of a hardware of an apparatus for controlling a fuel injection quantity from an injector for supplying a fuel to an internal combustion engine, as an example of an internal combustion engine control apparatus to which the present invention is applied. A detecting method of the present invention can be applied to a four-cycle single-cylinder internal combustion engine or a four cycle multi-cylinder internal combustion engine having an intake pipe for each cylinder, and in this embodiment, the method is applied to a four cycle single-cylinder internal combustion engine.

In FIG. 1, reference numeral 1 denotes a microcomputer including a CPU 101, an A/D converter 102, a RAM 103, a ROM 104, a timer 105 and the like, and reference numeral 2 denotes an injector mounted on an intake pipe of an internal combustion engine not shown. The injector 2 opens a valve thereof and injects fuel given from a fuel pump not shown into an intake pipe when driving pulse is given. Pressure of fuel given to the injector from the fuel pump is maintained to be constant, and therefore a fuel injection quantity from the injector is determined by a pulse width (time for which the valve of the injector is opened) of the driving pulse.

Reference numeral 3 denotes a pulser, which detects a reluctor (a projection or a recessed portion to cause a change in magnetic flux) provided at a rotational body (for example, a fly wheel) mounted on a crankshaft of the internal combustion engine and generates pulse signals with different polarities. The pulser 3 includes, for example, an iron core having a magnetic pole portion opposing to the reluctor at a top end, a signal coil wound around the iron core, and a permanent magnet magnetically coupled to the iron core, and it generates the pulse signals with the different polarities when it detects edges of a front end side and a rear end side in a rotational direction of the reluctor. A first and a second pulse signals generated by the pulser 3 are waveform-shaped by waveform shaping circuits 4 and 5 to be input to the CPU.

Reference numeral 6 denotes an intake pressure sensor comprised of an intake pressure sensor provided to detect the intake pipe pressure at a downstream side from a throttle valve of the intake pipe of the engine, reference numeral 7 denotes a water temperature sensor which detects cooling water temperature of the engine as the temperature of the engine, and reference numeral 8 denotes an intake air temperature sensor which detects the temperature of air inside the intake pipe as the intake air temperature. Output signals from the intake pressure sensor 6, the water temperature sensor 7 and the intake air temperature sensor 8 are inputted into the CPU 101 through an input interface circuit 9 and the A/D converter 102 inside the microcomputer.

By executing a predetermined program stored in the ROM 104, the CPU 101 of the microcomputer realizes function realizing means such as each means to construct the atmospheric pressure detecting apparatus of the present invention, intake air quantity operation means which obtains an intake air quantity in accordance with the intake pipe pressure that is detected by the intake pressure sensor and rotational speed of the engine, injection quantity operation means which arithmetically operates an fuel injection quantity with respect to the control conditions such as an intake air quantity, atmospheric pressure, cooling water temperature of the engine, and intake air temperature, and injection timing detection means which detects fuel injection timing, and it outputs an injection command signal having the signal width corresponding to a fuel injecting time from the output port when a fuel injection timing is detected. The injection command signal is given to an injector drive circuit 11 through an output interface circuit 10. The injector drive circuit 11 gives the driving pulse having pulse width equal to the signal width of the injection command signal to the injector 2. The injector 2 opens its valve during the time in which the driving pulse is given by the injector drive circuit, and injects fuel into the intake pipe.

FIG. 2A to FIG. 2C, FIG. 3A to FIG. 3C, FIG. 4A to FIG. 4C and FIG. 5A to FIG. 5C show a change with time in the intake pipe pressure, with a change in stroke of the engine and the output signal waveform of the pulser 3, when the opening degree of the throttle valve is adjusted to make a rotational speed N constant with respect to various loads of the engine. FIG. 2A, FIG. 3A, FIG. 4A and FIG. 5A show the change in the stroke of the engine, and in these drawings, "Su", "Co", "Ep" and "Eh" represent an intake stroke, a compression stroke, an expansion stroke and an exhaust stroke, respectively. TDC indicates a timing in which a rotational angle position of a crankshaft of the engine corresponds to a top dead center of a piston (hereinafter referred to a top dead center position).

FIG. 2B, FIG. 3B, FIG. 4B and FIG. 5B show first and second pulse signals Vp1 and Vp2 which are outputted by the pulser 3. The first pulse signal Vp1 occurs at a timing t1 in which the rotational angle position of the crankshaft of the engine corresponds to a reference position which is set at a position advanced sufficiently from the top dead center position, and the second pulse signal Vp2 occurs at a timing t2 in which the rotational angle position of the crankshaft corresponds to an ignition position at a starting time and at a low speed state of the engine which is set in the vicinity of the top dead center.

Figure 2A:
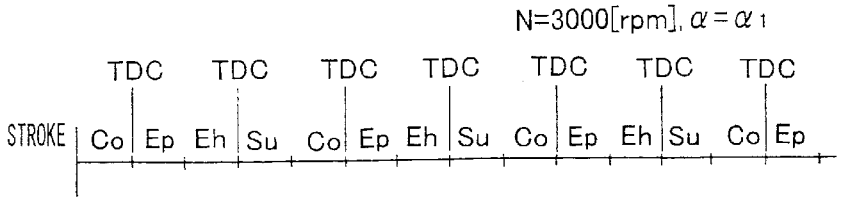
FIG. 2A to FIG. 2C are timing charts showing a change with time in intake pipe pressure of the internal combustion engine in a state where a throttle valve is substantially fully opened, with a throttle valve being in substantially a fully opened state with a change of strokes of the engine and output signal waveforms of a pulser.
Figure 2B:
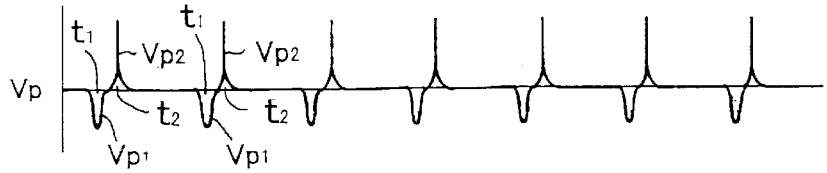
Figure 2C:
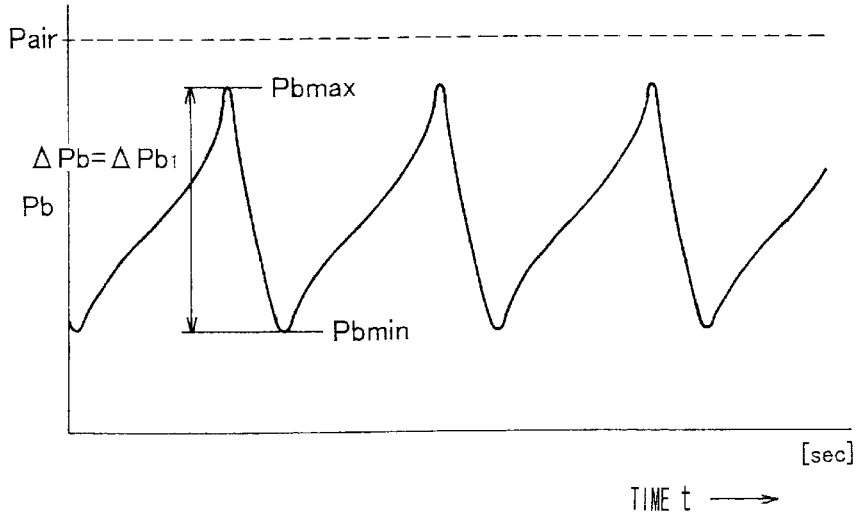
Figure 4A:
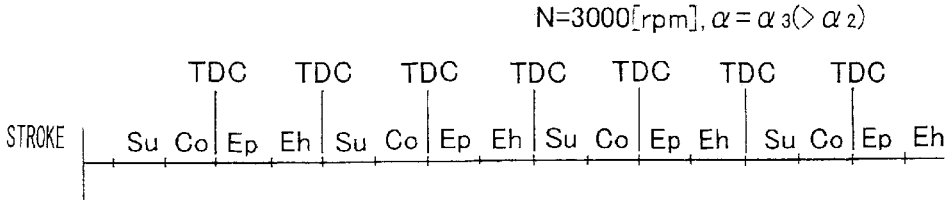
FIG. 4A to FIG. 4C are timing charts showing a change with time in the intake pipe pressure of the internal combustion engine when the opening degree of the throttle valve is made larger than in the state of FIG. 3, with the change of the strokes of the engine and the output signal waveforms of the pulser.
Figure 4B:
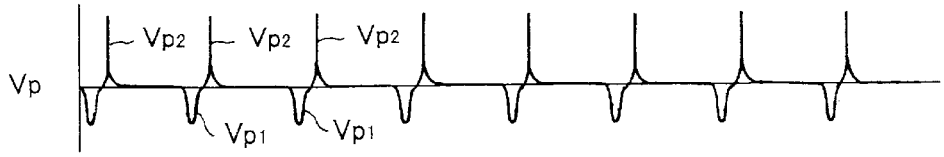
Figure 4C:
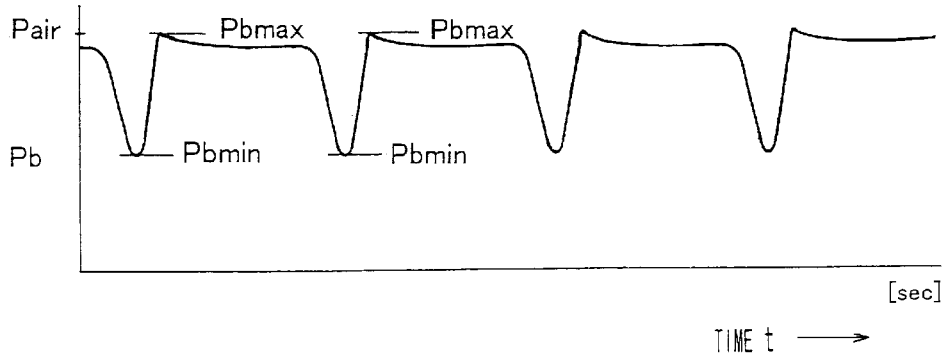
Figure 3A:
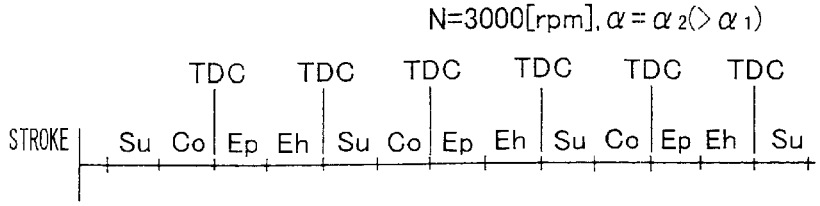
FIG. 3A to FIG. 3C are timing charts showing a change with time in the intake pipe pressure of the internal combustion engine when the opening degree of the throttle valve is made larger than the state of FIG. 2, with the change of the strokes of the engine and the output signal waveforms of the pulser.
Figure 3B:
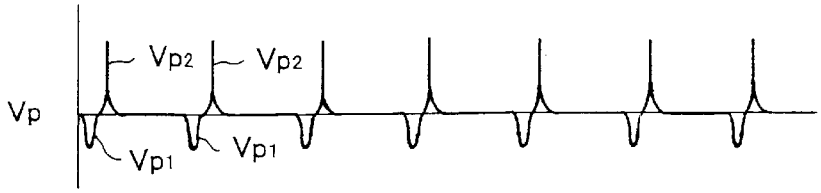
Figure 3C:
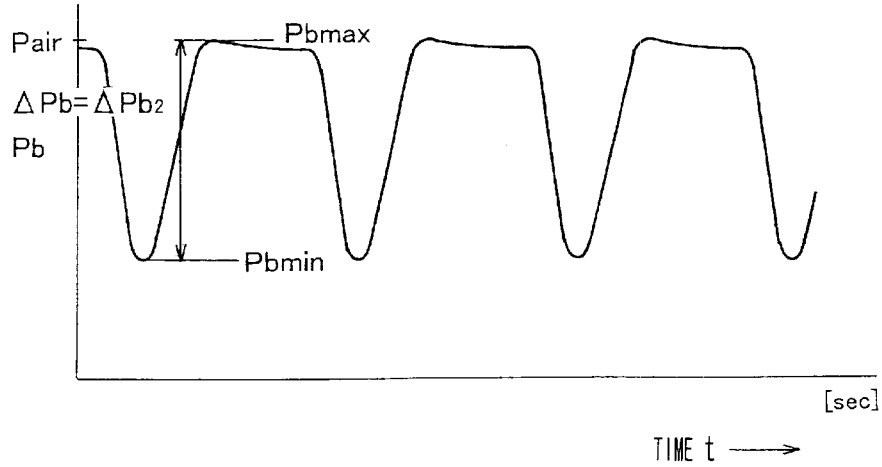
Figure 5A:
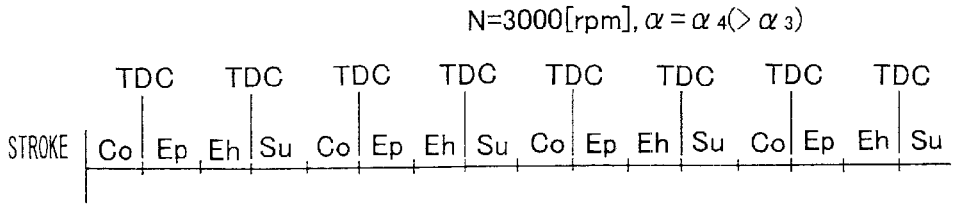
FIG. 5A to FIG. 5C are timing charts showing a change with time in the intake pipe pressure of the internal combustion engine when the opening degree of the throttle valve is made larger than in the state of FIG. 4 and the throttle valve is substantially fully opened, with the change of the strokes of the engine and the output signal waveforms of the pulser.
Figure 5B:
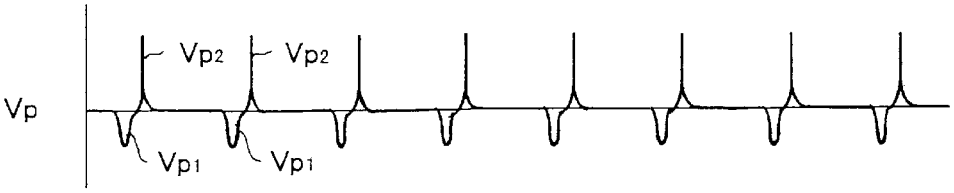
Figure 5C:
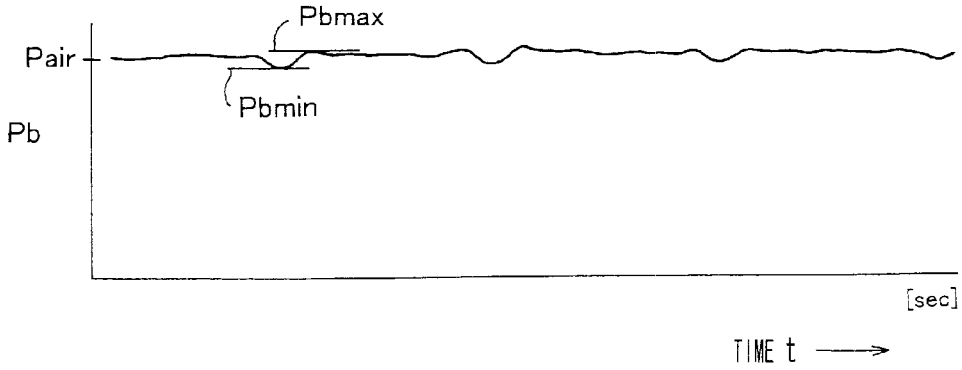

FIG. 2C, FIG. 3C, FIG. 4C and FIG. 5C show a change in intake pipe pressure Pb when an opening degree $\alpha$ of the throttle valve is adjusted so that the rotational speed N of the engine is maintained at 3000 [rpm] with respect to various loads of the engine, FIG. 2C shows a change in the intake pipe pressure Pb when the load of the engine is in a state of almost no load and the opening degree $\alpha$ of the throttle valve is $\alpha 1$ (when the throttle valve is in substantially a totally closed state), and FIG. 3C shows a change in the intake pipe pressure Pb when the load of the engine is increased and the opening degree $\alpha$ of the throttle valve is made $\alpha 2$ ($>\alpha 1$). FIG. 4C shows a change in the intake pipe pressure Pb when load is further increased and the opening degree $\alpha$ of the throttle valve is made $\alpha 3$. FIG. 5C shows a change in the intake pipe pressure Pb when the load of the engine is further increased and the opening degree $\alpha$ of the throttle valve is made $\alpha 4$ ($>\alpha 3$) (when the throttle valve is in substantially a totally opened state). In FIG. 2C to FIG. 4C, Pbmax and Pbmin show a maximum value and a minimum value of the intake pipe pressures which occur during the time in which the engine performs one combustion cycle and Pair shows the atmospheric pressure. $\Delta$Pb shows an intake pipe pressure change quantity occurring during one combustion cycle of the engine. The intake pipe pressure change quantity is given as an absolute value of the difference between the maximum value Pbmax and the minimum value Pbmin.

The intake pipe pressure of a single cylinder internal combustion engine and a multi-cylinder internal combustion engine having an intake pipe for each cylinder shows a large variation with respect to a change of strokes especially when the throttle valve is in a state in which it is hardly opened (when the engine is in a state with substantially no load). In the state in which the throttle valve is hardly opened, as shown in FIG. 2C, the intake pipe pressure is abruptly reduced when the combustion cycle of the internal combustion engine is in the intake stroke Su, and it kept reducing until the intake stroke is finished. When the intake stroke is finished, air flows into the intake pipe through a small gap of a peripheral part of the throttle valve due to pressure difference between the atmospheric pressure at an upstream of the throttle valve and a high negative intake pipe pressure (the state in which air pressure is very low), and therefore the intake pipe pressure gradually rises. In a state in which the throttle valve is hardly opened, the next intake stroke is started before the intake pipe pressure reaches the atmospheric pressure Pair, and the intake pipe pressure is abruptly reduced again. In such a state, the intake pipe pressure does not reach the atmospheric pressure, and therefore the maximum value Pbmax of the intake pipe pressure cannot be used as a detection value of the atmospheric pressure.

On the other hand, when the throttle valve opening degree $\alpha$ becomes $\alpha 2$ as a result that a load to some extent is exerted on the engine, charging speed of the intake air into the intake pipe after the completion of the intake stroke becomes high. Therefore as shown in FIG. 3C, the intake pipe pressure reaches the atmospheric pressure Pair before the next intake stroke Su is started, and the intake pipe pressure change quantity $\Delta$Pb indicates a value $\Delta$Pb2 which is smaller than a value $\Delta$Pb1 in the state in FIG. 2 under substantially no load.

When the load on the engine is further increased, the throttle valve is further opened, and the opening degree becomes $\alpha 3$, a quantity of change in the pressure in the intake pipe is further reduced as shown in FIG. 4C, and when the load is further increased and the opening degree of the throttle valve becomes $\alpha 4$ (substantially fully opened state), reduction in the intake pipe pressure is hardly seen as shown in FIG. 5C.

From the above-described result, in the state in which the throttle valve is opened to some extent, and the intake pipe pressure change quantity $\Delta$Pb is a certain value or less, the maximum value of the intake pipe pressure reaches the atmospheric pressure, and therefore it is understood that the maximum value Pbmax of the intake pipe pressure can be used as a detection value of the atmospheric pressure.

By paying attention to the characteristic of the intake pipe pressure as described above, the detection method of the present invention is to detect the atmospheric pressure without using a throttle sensor and an atmospheric pressure sensor, and an area in which the intake pipe pressure change quantity shows a value which is a predetermined set value or less is taken as an atmospheric pressure detection area, and when the atmospheric pressure detection area is detected, the maximum value of the intake pipe pressure is taken as a detection value of the atmospheric pressure.

Namely, in the present invention, intake pipe pressure detection means, which samples the intake pipe pressure at a downstream side from the throttle valve of the internal combustion engine at predetermined sampling intervals and detects it as the absolute pressure, is provided, and a difference between the maximum value and the minimum value of the intake pipe pressure sampled while the internal combustion engine performs one combustion cycle is obtained as the intake pipe pressure change quantity, and when the intake pipe pressure change quantity is a set value or less, the maximum value of the intake pipe pressure is made the detection value of the atmospheric pressure.

The set value of the intake pipe pressure change quantity which is used to detect the atmospheric pressure detection area is set at a value a little smaller than the value of the maximum value Pbmax of the intake pipe pressure when it reaches the atmospheric pressure, for example, at $\Delta$Pb2 in FIG. 3C, based on the result of the experiment.

The atmospheric pressure detecting method of the present invention is carried out, for n cycle or n cycles of combustion of the aforementioned internal engine (n is an integer of 1 or more), by using a microcomputer, but when the present invention is carried out, it is preferable to carry out a maximum/minimum value detection process for detecting the maximum value and the minimum value of the intake pipe pressure detected while the internal combustion engine performs one combustion cycle; an intake pipe pressure change quantity detection process for obtaining the absolute value of the difference between the maximum value and the minimum value detected in the maximum/minimum value detection process as an intake pipe pressure change quantity; and an atmospheric pressure detection condition determining process to determine that the atmospheric pressure detection condition is satisfied when comparing the intake pipe pressure change quantity obtained each time the intake pipe pressure change quantity is obtained in the intake pipe pressure change quantity detection process with a previously determined set value and finding the intake pipe pressure change quantity is the set value or less, and when it is determined that the atmospheric pressure detection condition is satisfied in all the n times of atmospheric pressure detection condition determining process, it is preferable to make the maximum value of the intake pipe pressure detected in the maximum/minimum value detection process a detection value of the atmospheric pressure.

In this case, when it is determined that the atmospheric pressure detection condition is satisfied in all the n times of atmospheric detection condition determining process, the maximum value of the intake pipe pressure detected in the final combustion cycle out of the n cycle or n cycles of combustion may be taken as a detection value of the atmospheric pressure, and an average value of n maximum values of the intake pipe pressure detected in n cycle or n cycles of combustion may be taken as a detection value of the atmospheric pressure.

The atmospheric pressure detecting apparatus to carry out the above-described detection method has the construction including intake pipe pressure detection means for sampling, at predetermined sampling intervals, output of the intake pressure sensor which is provided to detect the intake pipe pressure at a downstream side from the throttle valve inside the intake pipe provided for each cylinder of the internal combustion engine, and detecting it as a absolute pressure; maximum/minimum value detection means for detecting the maximum value and the minimum value of the intake pipe pressure detected while the internal combustion engine performs one combustion cycle; intake pipe pressure change quantity detection means for obtaining the absolute value of the difference between the maximum value and the minimum value detected by the maximum/minimum value detection means as an intake pipe pressure change quantity; and an atmospheric pressure detection condition determining means for determining that the atmospheric pressure detection condition is satisfied when comparing the intake pipe pressure change quantity obtained each time the intake pipe pressure change quantity is obtained by the intake pipe pressure change quantity detection means with a previously determined set value and finding the intake pipe pressure change quantity is the set value or less; and atmospheric pressure detection value determining means for making a storage device store the maximum value of the intake pipe pressure detected in the maximum/minimum value detection process as the detection value of the atmospheric pressure when it is determined that the atmospheric pressure detection condition is satisfied by the atmospheric pressure detection condition determining means in all the combustion cycles while the internal combustion engine performs n cycle or n cycles of combustion of the aforementioned internal engine (n is an integer of 1 or more).

Each of the above-described means can be realized by making the CPU 101 execute the program stored in the ROM 104.

When the detecting method of the present invention is applied to a multi-cylinder internal combustion engine provided with an intake pipe for each cylinder, detection of the intake pipe pressure is performed for all the intake pipes and the detection values of the atmospheric pressure detected based on the respective intake pipe pressures may be averaged, but generally, it is sufficient to detect the intake pipe pressure by sampling output of one intake pressure sensor that is provided to detect the intake pipe pressure at a downstream side from the throttle valve in the intake pipe provided for one cylinder of the internal combustion engine to perform detection of atmospheric pressure based on the detection value.

On carrying out the present invention, a process in which a timer inside the microcomputer is made to measure sampling intervals for the intake pipe pressure and the output of the intake pressure sensor is read each time the timer measures a sampling interval is provided in the program executed by the CPU. This process and the intake pressure sensor 6 shown in FIG. 1 constructs the intake pipe pressure detection means for sampling the output of the intake pressure sensor for detecting the intake pipe pressure at the downstream side from the throttle valve in the intake pipe provided for one cylinder of the internal combustion engine.

Each time the intake pipe pressure is sampled, interrupt routine is executed, whereby the aforementioned maximum/minimum value detection means, the intake pipe pressure change quantity detection means, the atmospheric pressure detecting condition determining means and the atmospheric pressure detection value determining means are comprised, and the aforementioned maximum/minimum value detection process, the intake pipe pressure change quantity detection process, the atmospheric pressure detecting condition determining process and the process in which the maximum value of the intake pipe pressure is determined as the detection value of the atmospheric pressure when the atmospheric pressure detecting condition is satisfied are carried out.

Figure 6:
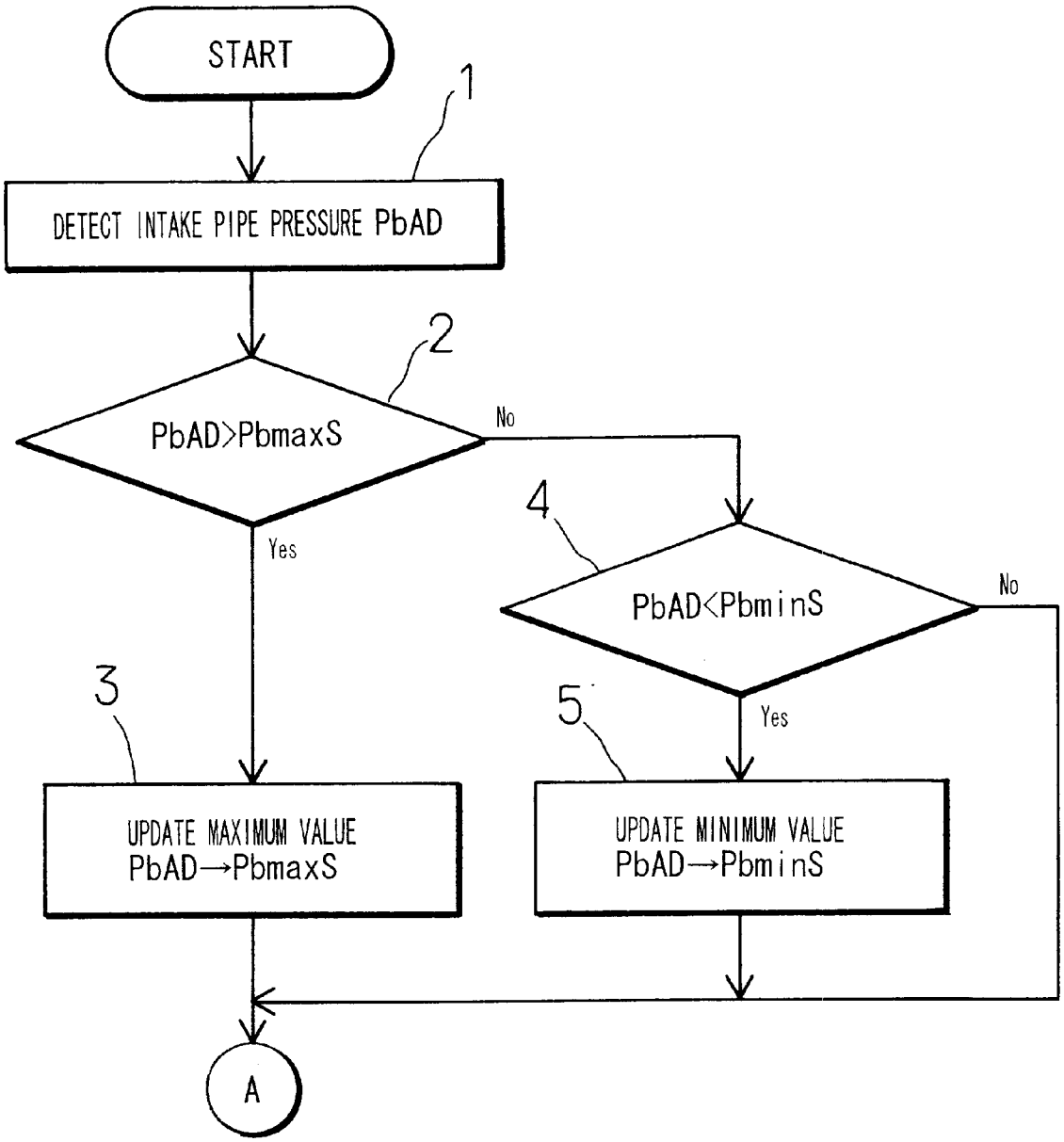
FIG. 6 is a flowchart showing a construction of a part of a program of an interruption routine executed by a CPU each time the intake pipe pressure is sampled in an embodiment of the present invention.
Figure 7:
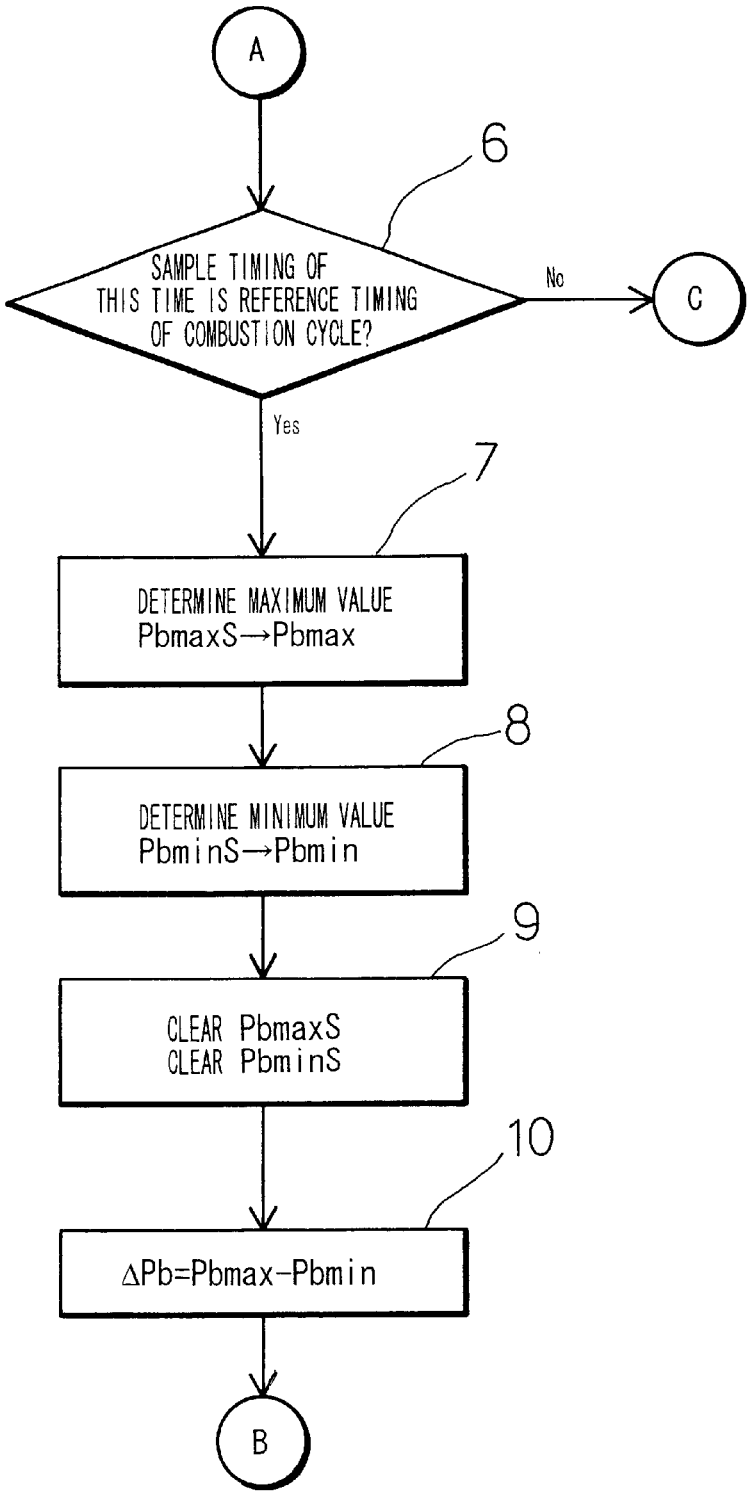
FIG. 7 is a flowchart showing a construction of another part of the same program.
Figure 8:
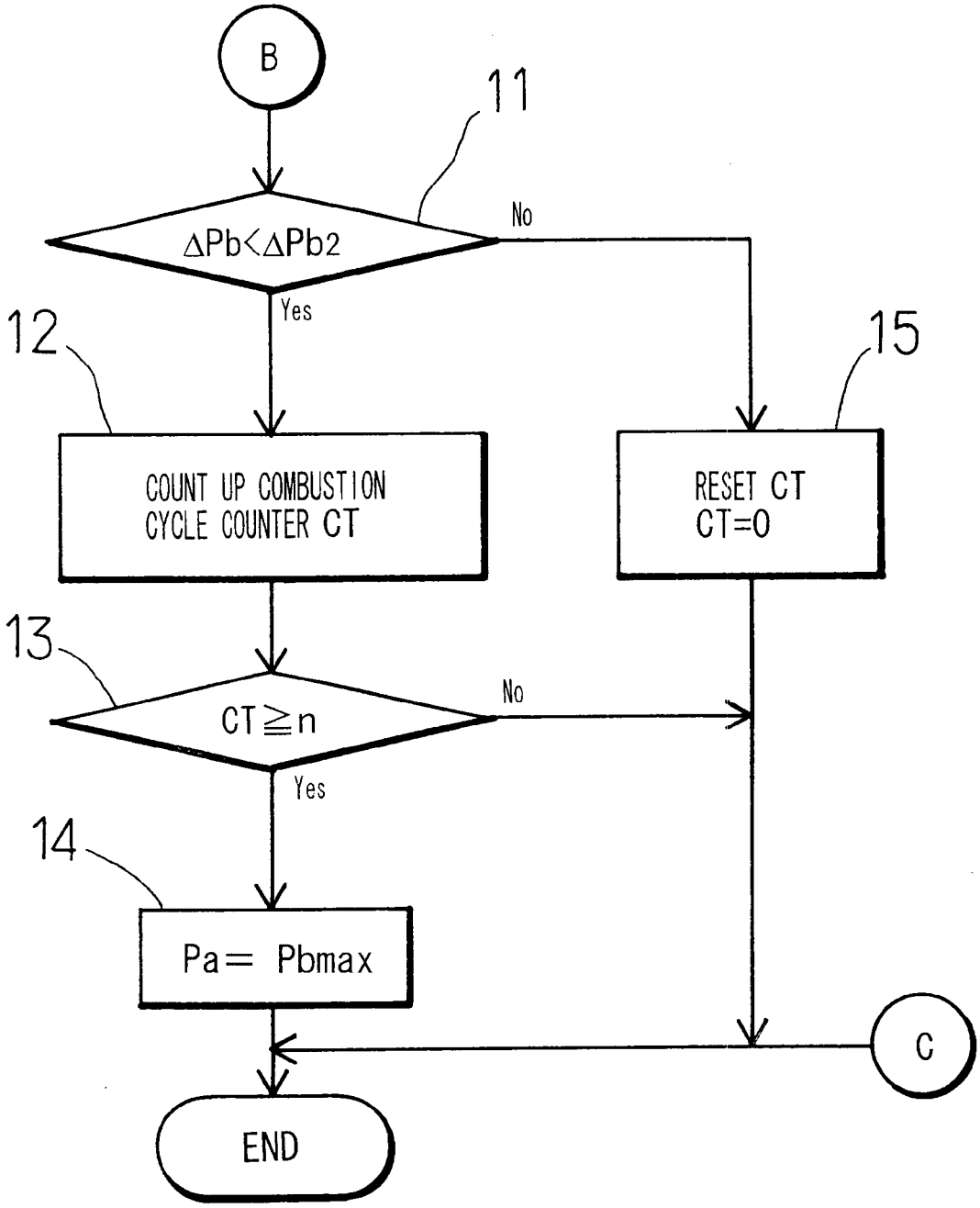
FIG. 8 is a flowchart showing a construction of further another part of the same program.

One example of algorithm of the interrupt routine, which comprises the atmospheric pressure detecting apparatus according to the present invention and which is carried out by the CPU each time the intake pipe pressure is sampled to carry out the atmospheric pressure detecting method according to the present invention, is shown in FIG. 6 to FIG. 8.

In the flowcharts shown in FIG. 6 to FIG. 8, PbAD denotes intake pipe pressure newly sampled, and PbmaxS and PbminS denote the maximum value and the minimum value of the intake pipe pressures which are detected so far in the same combustion cycle and stored in a storage device (RAM).

In the case of following this algorithm, the intake pipe pressure PbAD is firstly read at Step 1 in FIG. 6 when the sample timing is detected, and then at Step 2, the intake pipe pressure PbAD that is newly read is compared with the maximum value PbmaxS of the intake pipe pressure that is detected so far. As a result, when PbAD>PbmaxS, the maximum value of the intake pipe pressure is updated by making the intake pipe pressure PbAD that is detected this time to be the maximum value PbmaxS of the intake pipe pressure at Step 3, and thereafter the step is shifted to Step 6 in FIG. 7 is taken. Since the maximum value of the intake pipe pressure is not obtained at first, Step 3 is executed following Step 2. When it is determined that PbAD≦PbmaxS at Step 2, Step 4 is taken and PbAD is compared with the minimum value Pbmin of the intake pipe pressure that is detected so far. As a result, when it is determined that PbAD<PbminS, the intake pipe pressure PbAD that is detected this time is taken as the minimum value PbminS, and the step is shifted to the Step 6 in FIG. 7. When it is determined that PbAD≧PbminS in Step 4, the step is shifted to Step 6 in FIG. 7 is taken. Since the minimum value of the intake pipe pressure is not detected yet when Step 4 is executed at first, the step is shifted from Step 4 to Step 6 in FIG. 7.

At Step 6 in FIG. 7, it is determined whether or not the sample timing of this time is a reference timing of the combustion cycle. Here, the reference timing of the combustion cycle means the timing which is used as a reference when it is determined whether or not one combustion cycle is finished. This reference timing is set, for example, at a timing in which the position of the rotational angle of the crankshaft corresponds to the position of the top dead center at the time of completion of an exhaust stroke, or at a timing in the vicinity of the timing in which the position of rotational angle of the crankshaft corresponds to the position of the top dead center at the time of completion of the exhaust stroke.

In the case in which a camshaft sensor which generates a pulse signal at the time of completion of the exhaust stroke is mounted on the engine, the above-described reference timing can be detected by detecting the output pulse of the camshaft sensor.

In the case, as in this embodiment, in which the pulser 3 is comprised to generate a second pulse signal at a position near the top dead center (the position of the rotational angle corresponding to the top dead center of the piston) of the crankshaft, the timing in which the pulser 3 initially generates the second pulse signal Vp2 after the intake pipe pressure shows the minimum value can be taken as the reference timing of the combustion cycle.

As a result of executing Step 6 in FIG. 7, when it is determined that the sample timing of this time corresponds to the reference timing, the step is shifted to Step 7 is taken and the maximum value PbmaxS of the intake pipe pressure which is already obtained is taken as Pbmax to determine the maximum value of the intake pipe pressure, and the minimum value PbminS of the intake pipe pressure which is already obtained at Step 8 is taken as Pbmin to determine the minimum value of the intake pipe pressure. Next, at Step 9, the content of the RAM storing PbmaxS and the content of the RAM storing PbminS are cleared. At Step 10, the intake pipe pressure change quantity ΔPb=Pbmax−Pbmin is arithmetically operated and the result is stored in the RAM.

Next, the step is shifted to Step 11 in FIG. 8 to compare ΔPb and the set value ΔPb2, and when ΔPb<ΔPb2, Step 12 is taken to count up the combustion cycle counter which counts the number of times the combustion cycle is performed. Next, the step is shifted to Step 13 to compare a count value CT of the combustion cycle counter with a set value n (n is a integer that is 1 or more), and when it is determined that CT<n, the interrupt routine in the sample timing of this time is finished. It is preferable that the set value n is set at 3 to 4 (n=3 to 4).

At Step 13, when it is determined that CT≧n, the step is shifted to Step 14, and the maximum value Pbmax of the intake pipe pressure, which is detected in the final combustion cycle out of the combustion cycle carried out n times, is stored as the detection value Pa of atmospheric pressure. At Step 11 in FIG. 8, when it is determined that ΔPb≧ΔPb2, the step is shifted to Step 15 to reset the combustion cycle counter to set the count value CT at 0.

At Step 6 in FIG. 7, when it is determined that the sample timing of this time is not the reference timing, nothing is performed and the step is shifted to "END" in FIG. 8, where the interrupt routine in the sample timing of this time is finished.

In the present embodiment, the maximum/minimum detection means is realized by Steps 2 to 5 in FIG. 6 and Step 6 to 9 in FIG. 7, and each time the intake pipe pressure is sampled these Steps are executed, whereby the maximum value PmaxS and the minimum value PminS of the intake pipe pressures that are detected in a period of one combustion cycle are detected.

Also, the intake pipe pressure change quantity detection means, which obtains the absolute value of the difference between the maximum value and the minimum value that are detected by the maximum/minimum detection means as the intake pipe pressure change quantity ΔPb, is realized by Step 10 in FIG. 7.

Further, Step 11 in FIG. 8 realizes the atmospheric pressure detection condition determining means which compares the intake pipe pressure change quantity that is obtained each time the intake pipe pressure change quantity detection means obtains the intake pipe pressure change quantity ΔPb with the set value ΔPb2 that is previously set and determines that the atmospheric detection condition is satisfied when the intake pipe pressure change quantity is the set value or less.

Steps 12 to 14 in FIG. 8 realize the atmospheric pressure detection value determining means which determines the maximum value of the intake pipe pressure as the detection value, that is detected by the maximum/minimum value detection process when it is determined that the atmospheric detection condition is satisfied by the atmospheric detection condition determining means in all the combustion cycles while the internal combustion engine carries out n cycle or n cycles of combustion (n represents an integer of 1 or more), and which makes the storage device store the detection value.

In the above description, the rotational speed of the engine is 3000 [rpm] (fixed). In the state in which the rotational speed of the engine is not so high, and an amount of air flowing through the intake pipe is not so large as above, the atmospheric pressure can be detected with substantially no error by the above-described method.

However, when the rotational speed of the engine becomes higher, and the amount of air flowing through the intake pipe becomes larger, pressure loss in an intake passage is increased, thus causing the state in which the maximum value of the intake pipe pressure does not reach the atmospheric pressure. In such a state, if the maximum value of the intake pipe pressure is taken as the detection value of atmospheric pressure, the detection error becomes large. Accordingly, when carrying out the above-described detection method, it is preferable to detect atmospheric pressure in the operation area in which the rotational speed of the engine is the set value or less, then store the detection value, and carry out a control of the engine (for example, control of a fuel injection quantity) from a low speed area to a high speed area with the stored detection value of the atmospheric pressure being one control condition.

When it is necessary to detect atmospheric pressure with high precision at all times irrespective of the rotational speed of the internal combustion engine, it is preferable to determine the maximum value of the intake pipe pressure detected when the intake pipe pressure change quantity is a set value or less as a basic detection value, and determine a value obtained by correcting the basic detection value by a correction amount determined in accordance with the rotational speed as the detection value of the atmospheric pressure.

In this case, correction of the basic detection value may be performed by adding the correction value determined in accordance with the rotational speed of the engine to the basic detection value, or may be performed by multiplying a correction coefficient determined in accordance with the rotational speed of the engine by the basic detection value.

In the case in which the detection value of the atmospheric pressure is obtained by correcting the maximum value of the intake pipe pressure as described above, the intake pipe pressure detection means which samples the output of the intake pressure sensor that is provided to detect the intake pipe pressure at a downstream side from the throttle valve inside the intake pipe provided for one cylinder of the internal combustion engine at predetermined sample intervals to detect the intake pipe pressure as the absolute pressure; the maximum/minimum value detection process for detecting the maximum value and the minimum value of the intake pipe pressures detected while the internal combustion engine performs one combustion cycle, the intake pipe pressure change quantity detection process for obtaining the absolute value of the difference between the maximum value and the minimum value detected in the maximum/minimum value detection process as the intake pipe pressure change quantity, and the atmospheric pressure detection condition determining process for comparing the intake pipe pressure change quantity, which is obtained each time the intake pipe pressure change quantity is obtained in the intake pipe pressure change quantity detection process, with the previously fixed set value and determining that the atmospheric pressure detection condition is satisfied when the intake pipe pressure change quantity is the set value or less are carried out for n cycle or n cycles of combustion (n represents an integer of 1 or more) of the internal combustion engine; the maximum value of the intake pipe pressure, which is detected in the maximum/minimum value detection process when it is determined that the atmospheric pressure detection condition is satisfied in all the n times of atmospheric pressure detection condition determining process that are carried out for n cycle or n cycles of combustion, is taken as the basic detection value of the atmospheric pressure, and the value, which is obtained by adding the correction value determined in accordance with the rotational speed of the internal combustion engine to the basic detection value, is taken as the detection value of the atmospheric pressure.

In this case, it is also suitable that the maximum value of the intake pipe pressure detected in the final combustion cycle out of the n combustion cycle or cycles is taken as the basic detection value when it is determined that the atmospheric pressure detection condition is satisfied in all of the n times of the atmospheric detection condition determining processes, or it is also suitable that the average value of n of the maximum values of the intake pipe pressures detected in n cycle or n cycles of combustion may be taken as the basic detection value.

The atmospheric pressure detecting apparatus for carrying out the above-described detecting method can be comprised of the intake pipe pressure detection means which samples the output of the intake pressure sensor provided to detect the intake pipe pressure at the downstream side from the throttle valve inside the intake pipe provided for one cylinder of the internal combustion engine at predetermined sampling intervals and detects the intake pipe pressure as the absolute pressure; the maximum/minimum value detection means which detects the maximum value and the minimum value of the intake pipe pressure detected while the internal combustion engine carrying out one combustion cycle; the intake pipe pressure change quantity detection means which obtains the absolute value of the difference between the maximum value and the minimum value detected by the maximum/minimum detection means as the intake pipe pressure change quantity; the atmospheric pressure detection condition determining means which compares the intake pipe pressure change quantity that is obtained each time the intake pipe pressure change quantity detection means obtains the intake pipe pressure change quantity with the previously determined set value and determines that the atmospheric pressure detection condition is satisfied when the intake pipe pressure change quantity is the set value or less; the atmospheric pressure basic detection value determining means which determines the maximum value of the intake pipe pressure detected in the maximum/minimum value detection process is determined as the basic detection value of the atmospheric pressure when it is determined that the atmospheric pressure detection condition is satisfied in all the combustion cycles while the internal combustion engine performs n cycle or n cycles of combustion (n represents an integer of 1 or more); the rotational speed detection means which detects the rotational speed of the internal combustion engine; map storing means which stores a rotational speed/correction value map which gives the relationship between the rotational speed of the internal combustion engine and the correction value which is needed to be added to the basic detection value to obtain atmospheric pressure; correction value arithmetic operation means which arithmetically operates the correction value from the rotational speed/correction value map in accordance with the rotational speed of the internal combustion engine that is detected from the aforementioned rotational speed detection means; and atmospheric pressure detection value arithmetic operation means which obtains a detection value of atmospheric pressure by adding the correction value to the basic detection value.

The rotational speed detection means which detects the rotational speed of the internal combustion engine can be comprised of, for example, a timer for detecting a generation interval (time interval) of the output pulse of the pulser 3 and the process for performing arithmetic operation to convert the generation interval of pulse detected by the timer into rotational speed.

Figure 9:
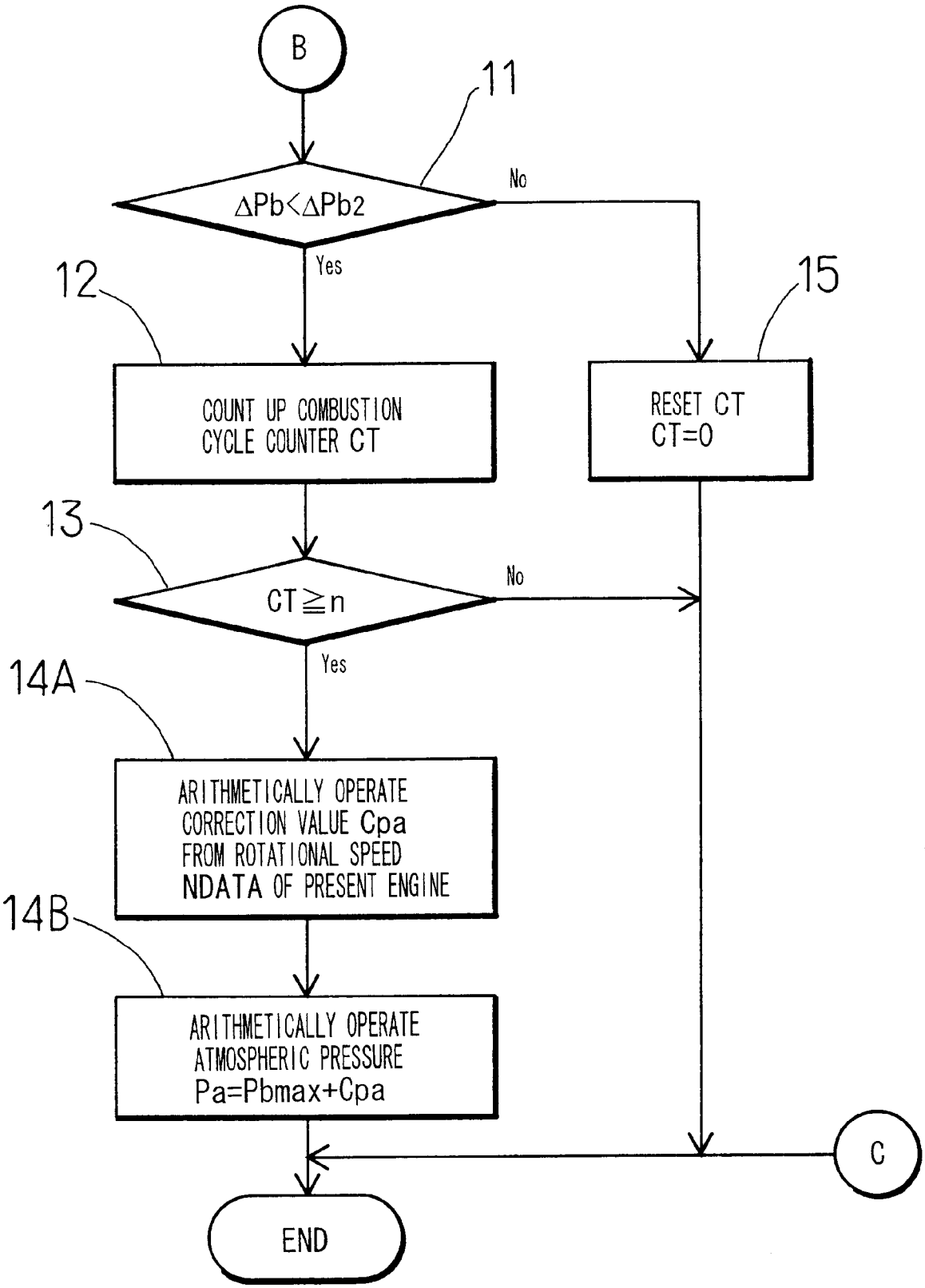
FIG. 9 is a flowchart showing an example of a construction of a part corresponding to FIG. 8 of the program of the interrupt routine executed when a detection value of the atmospheric pressure is obtained by adding a correction value to a basic detection value, being set the maximum value of the intake pipe pressure as the basic detection value of the atmospheric pressure.

Taking the maximum value Pbmax of the intake pipe pressure as the basic detection value when the atmospheric pressure detection condition is satisfied, when the detection value of atmospheric pressure is obtained by adding the correction value to the basic detection value Pbmax, it is suitable that the rotational speed/correction value map which gives the relationship of the rotational speed of the internal combustion engine and the correction value needed to be added to the basic detection value to obtain atmospheric pressure is stored in the ROM of the microcomputer, and out of each process of the interrupt routine shown in the aforementioned FIG. 6 to FIG. 8, Step 14 shown in FIG. 8 is changed as Steps 14A and 14B shown in FIG. 9, for example.

Namely, in this case, when it is determined that the count value CT of the combustion cycle counter reaches the set value n in Step 13, the correction value Cpa for the present rotational speed is arithmetically operated with use of the detection value NDATA of the present rotational speed of the engine and the rotational speed/correction value map in Step 14A in FIG. 9, and subsequently, arithmetic operation of adding the correction value Cpa to the basic detection value Pbmax is carried out in Step 14B to arithmetically operate the detection value Pa of atmospheric pressure.

In this case, Step 14A in FIG. 9 comprises the correction value arithmetical operating means, and Step 14B comprises the atmospheric pressure detection value arithmetically operating means.

As described above, according to the present invention, the absolute value of the difference between the maximum value and the minimum value of the intake pipe pressure, which occurs while the engine performs one combustion cycle, is detected as the intake pipe pressure change quantity, and when the change quantity is a set value or less and the intake pipe pressure is in the state in which it reaches atmospheric pressure before the intake stroke is started, the maximum value of the detected intake pipe pressure is determined as the detection value of the atmospheric pressure, thus making it possible to detect atmospheric pressure and make it one of the control condition used to control the internal combustion engine without using a throttle sensor and an atmospheric pressure sensor.

In the present invention, when the maximum value of the intake pipe pressure, which is detected when the intake pipe pressure change quantity is a set value or less, is taken as the basic detection value of atmospheric pressure, and the detection value of atmospheric pressure is obtained by correcting the basic detection value by the correction amount determined by the rotational speed, the detection value of atmospheric pressure can be accurately obtained even in the state in which the rotational speed of the engine is high.

Although one preferred embodiment of the invention has been described and illustrated with reference to the accompanying drawings, it will be understood by those skilled in the art that it is by way of example, and that various changes and modifications may be made without departing from the spirit and scope of the invention, which is defined only to the appended claims.

What is claimed is:

1. An atmospheric pressure detecting method for controlling an internal combustion engine, which is a method of detecting atmospheric pressure as a control condition when controlling a fuel injection quantity from an injector for supplying fuel to the internal combustion engine, comprising the steps of:

providing intake pipe pressure detection means for sampling intake pipe pressure at a downstream side from a throttle valve of said internal combustion engine at predetermined sampling intervals and detecting it as absolute pressure;

obtaining an absolute value of a difference between a maximum value and a minimum value of the intake pipe pressure, which is sampled while said internal combustion engine performs one combustion cycle, as an intake pipe pressure change quantity; and taking the maximum value of the intake pipe pressure as a detection value of atmospheric pressure when the intake pipe pressure change quantity is equal to or less than a set value.

2. An atmospheric pressure detecting method for controlling an internal combustion engine, which is a method of detecting atmospheric pressure as a control condition when controlling a fuel injection quantity from an injector for supplying fuel to the internal combustion engine, comprising the steps of:

providing intake pipe pressure detection means for sampling intake pipe pressure at a downstream side from a throttle valve of said internal combustion engine at predetermined sampling intervals and detecting it as absolute pressure;

obtaining an absolute value of a difference between a maximum value and a minimum value of the intake pipe pressure, which is sampled while said internal combustion engine performs one combustion cycle, as an intake pipe pressure change quantity;

taking the maximum value of the intake pipe pressure as a basic detection value when the intake pipe pressure change quantity is equal to or less than a set value; and taking a value, which is obtained by correcting the basic detection value by a correction amount determined in accordance with rotational speed of the internal combustion engine, as a detection value of atmospheric pressure.

3. An atmospheric pressure detecting method for controlling an internal combustion engine, which is a method of detecting atmospheric pressure as a control condition when controlling a fuel injection quantity from an injector for supplying fuel to a single cylinder internal combustion engine or a multi-cylinder internal combustion engine provided with an intake pipe and a throttle valve at each cylinder, comprising the steps of:

providing intake pipe pressure detection means for sampling output of an intake pressure sensor, which is provided to detect intake pipe pressure at a downstream side from a throttle valve in the intake pipe provided for one cylinder of said internal combustion engine, at predetermined sampling intervals and detecting the intake pipe pressure as absolute pressure;

performing, for n cycle or n cycles of combustion of said internal combustion engine (n represents an integer of 1 or more),: a maximum/minimum detection process for detecting a maximum value and a minimum value of the intake pipe pressure detected while said internal combustion engine performs one combustion cycle, an intake pipe pressure change quantity detection process for obtaining an absolute value of a difference between the maximum value and the minimum value detected in the maximum/minimum value detection process as an intake pipe pressure change quantity, and an atmospheric pressure detection condition determining process for comparing an obtained intake pressure change quantity with a previously determined set value each time the intake pipe pressure change quantity is obtained in the intake pipe pressure change quantity detection process and determining that the atmospheric pressure detection condition is satisfied when the intake pipe pressure change quantity is equal to or less than the set value; and taking the maximum value of the intake pipe pressure detected in the maximum/minimum value detection process as a detection value of atmospheric pressure when it is determined that the atmospheric detection condition is satisfied in all the n time or n times of atmospheric pressure detection condition determining process performed for n cycle or n cycles of combustion.

4. The atmospheric pressure detection method for controlling the internal combustion engine according to claim 3, wherein when it is determined that the atmospheric pressure detection condition is satisfied in all the n time or n times of atmospheric pressure detection condition determining process, the maximum value which is detected in a final combustion cycle of the n cycle or n cycles of combustion is taken as the detection value of the atmospheric pressure.

5. The atmospheric pressure detection method for controlling the internal combustion engine according to claim 3, wherein when it is determined that the atmospheric pressure detection condition is satisfied in all the n time or n times of atmospheric pressure detection condition determining process, an average value of n of the maximum value or n of the maximum values of the intake pipe pressure which is or are detected in the n cycle or n cycles of combustion is taken as the detection value of the atmospheric pressure.

6. The atmospheric pressure detection method for controlling the internal combustion engine according to claim 4, wherein when it is determined that the atmospheric pressure detection condition is satisfied in all the n time or n times of atmospheric pressure detection condition determining process, an average value of n of the maximum value or n of the maximum values of the intake pipe pressure which is or are detected in the n cycle or n cycles of combustion is taken as the detection value of the atmospheric pressure.

7. The atmospheric pressure detection method for controlling the internal combustion engine according to claim 3, wherein only when the atmospheric pressure control condition is satisfied in a state in which rotational speed of said internal combustion engine is equal to or less than a set value, the maximum value of the intake pipe pressure is taken as the detection value of atmospheric pressure.

8. The atmospheric pressure detection method for controlling the internal combustion engine according to claim 4, wherein only when the atmospheric pressure control condition is satisfied in a state in which rotational speed of said internal combustion engine is equal to or less than a set value, the maximum value of the intake pipe pressure is taken as the detection value of atmospheric pressure.

9. An atmospheric pressure detecting method for controlling an internal combustion engine, which is a method of detecting atmospheric pressure as a control condition when controlling a fuel injection quantity from an injector for supplying fuel to a single cylinder internal combustion engine or a multi-cylinder internal combustion engine provided with an intake pipe and a throttle valve at each cylinder, comprising the steps of:

providing intake pipe pressure detection means for sampling output of an intake pressure sensor, which is provided to detect intake pipe pressure at a downstream side from a throttle valve in the intake pipe provided for one cylinder of said internal combustion engine, at predetermined sampling intervals and detecting the intake pipe pressure as absolute pressure;

performing, for n cycle or n cycles of combustion of said internal combustion engine (n represents an integer of 1 or more),: a maximum/minimum detection process for detecting a maximum value and a minimum value of the intake pipe pressure detected while said internal combustion engine performs one combustion cycle, an intake pipe pressure change quantity detection process for obtaining an absolute value of a difference between the maximum value and the minimum value detected in the maximum/minimum value detection process as an intake pipe pressure change quantity, and an atmospheric pressure detection condition determining process for comparing an obtained intake pressure change quantity with a previously determined set value each time the intake pipe pressure change quantity is obtained in the intake pipe pressure change quantity detection process and determining that the atmospheric pressure detection condition is satisfied when the intake pipe pressure change quantity is equal to or less than the set value; and taking the maximum value of the intake pipe pressure detected in the maximum/minimum value detection process as a basic detection value of atmospheric pressure when it is determined that the atmospheric detection condition is satisfied in all the n time or n times of atmospheric pressure detection condition determining process performed for n cycle or n cycles of combustion, and taking a value, which is obtained by correcting the basic detection value by a correction amount determined according to a rotational speed of said internal combustion engine, as a detection value of atmospheric pressure.

10. The atmospheric pressure detection method for controlling the internal combustion engine according to claim 9, wherein when it is determined that the atmospheric pressure detection condition is satisfied in all the n time or n times of atmospheric pressure detection condition determining process, the maximum value of intake pipe pressure which is detected in a final combustion cycle of the n cycle or n cycles of combustion is taken as the basic detection value.

11. An atmospheric pressure detecting apparatus for controlling an internal combustion engine, which is for detecting atmospheric pressure as a control condition when controlling a fuel injection quantity from an injector for supplying fuel to a single cylinder internal combustion engine or a multi-cylinder internal combustion engine provided with an intake pipe and a throttle valve at each cylinder, comprising:

intake pipe pressure detection means for sampling output of an intake pressure sensor, which is provided to detect intake pipe pressure at a downstream side from a throttle valve in the intake pipe provided for one cylinder of said internal combustion engine, at predetermined sampling intervals and detecting the intake pipe pressure as absolute pressure;

maximum/minimum value detection means for detecting a maximum value and a minimum value of the intake pipe pressure detected while said internal combustion engine performs one combustion cycle;

intake pipe pressure change quantity detection means for obtaining an absolute value of a difference between the maximum value and the minimum value detected by said maximum/minimum value detection means as an intake pipe pressure change quantity;

atmospheric pressure detection condition determining means for comparing an obtained intake pressure change quantity with a previously determined set value each time said intake pipe pressure change quantity detection means obtains the intake pipe pressure change quantity and determining that the atmospheric pressure detection condition is satisfied when the intake pipe pressure change quantity is equal to or less than the set value; and atmospheric pressure detection value determining means for determining the maximum value of the intake pipe pressure detected in the maximum/minimum value detection process as a detection value of atmospheric pressure when it is determined by said atmospheric pressure detection condition determining means that the atmospheric detection condition is satisfied in all the cycles of combustion while said internal combustion engine performs n cycle or n cycles of combustion (n represents an integer of 1 or more) and making a storage device store the detection value of atmospheric pressure.

12. An atmospheric pressure detecting apparatus for controlling an internal combustion engine, which is for detecting atmospheric pressure as a control condition when controlling a fuel injection quantity from an injector for supplying fuel to a single cylinder internal combustion engine or a multi-cylinder internal combustion engine provided with an intake pipe and a throttle valve at each cylinder, comprising:

intake pipe pressure detection means for sampling output of an intake pressure sensor, which is provided to detect intake pipe pressure at a downstream side from the throttle valve in the intake pipe provided for one cylinder of said internal combustion engine, at predetermined sampling intervals and detecting the intake pipe pressure as absolute pressure;

maximum/minimum value detection means for detecting a maximum value and a minimum value of the intake pipe pressure detected while said internal combustion engine performs one combustion cycle;

intake pipe pressure change quantity detection means for obtaining an absolute value of a difference between the maximum value and the minimum value detected by said maximum/minimum value detection means as an intake pipe pressure change quantity;

atmospheric pressure detection condition determining means for comparing an obtained intake pressure change quantity with a previously determined set value each time said intake pipe pressure change quantity detection means obtains the intake pipe pressure change quantity and determining that the atmospheric pressure detection condition is satisfied when the intake pipe pressure change quantity is equal to or less than the set value;

atmospheric pressure basic detection value determining means for determining the maximum value of the intake pipe pressure detected in the maximum/minimum value detection process as a basic detection value of atmospheric pressure when it is determined by said atmospheric pressure detection condition determining means that the atmospheric detection condition is satisfied in all the cycles of combustion while said internal combustion engine performs n cycle or n cycles of combustion (n represents an integer of 1 or more) and making a storage device store the basic detection value;

rotational speed detection means for detecting rotational speed of said internal combustion engine;

map storage means for storing a rotational speed/correction value map which gives relationship between the rotational speed of said internal combustion engine and a correction value needed to be added to the basic detection value to obtain the atmospheric pressure;

correction value operation means for arithmetically operating a correction value from the rotational speed/correction value map in accordance with the rotational speed of the internal combustion engine detected by said rotational speed detection means; and atmospheric pressure detection value operation means for obtaining the detection value of atmospheric pressure by adding said correction value to said basic detection value.

* * * * *